US007933533B2

(12) United States Patent
Higaki

(10) Patent No.: US 7,933,533 B2
(45) Date of Patent: Apr. 26, 2011

(54) CHARGING DEVICE HAVING CHARGING ROLLER WITH SPECIFIC CHARACTERISTIC AND IMAGE FORMING APPARATUS

(75) Inventor: Toshimasa Higaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 755 days.

(21) Appl. No.: 11/812,721

(22) Filed: Jun. 21, 2007

(65) Prior Publication Data

US 2008/0124131 A1 May 29, 2008

(30) Foreign Application Priority Data

Jun. 26, 2006 (JP) ..... 2006-175588

(51) Int. Cl.
*G03G 15/02* (2006.01)

(52) U.S. Cl. ..... 399/100; 399/175; 399/176

(58) Field of Classification Search ..... 399/100, 399/175, 176
See application file for complete search history.

(56) References Cited

U.S. PATENT DOCUMENTS

| | | | | |
|---|---|---|---|---|
| 5,610,691 | A * | 3/1997 | Takahashi et al. | 399/176 |
| 6,263,175 | B1 * | 7/2001 | Sawada et al. | 399/176 |
| 2005/0226659 | A1 * | 10/2005 | Ebe | 399/286 |

FOREIGN PATENT DOCUMENTS

| | | | |
|---|---|---|---|
| JP | 2000-172055 | A | 6/2000 |
| JP | 2001-042608 | | 2/2001 |
| JP | 2001-290340 | A | 10/2001 |
| JP | 2003-207966 | A | 7/2003 |

* cited by examiner

*Primary Examiner* — David M Gray
*Assistant Examiner* — Ryan D Walsh
(74) *Attorney, Agent, or Firm* — Kubotera & Associates LLC

(57) ABSTRACT

A charging device for charging an image supporting member includes a charging roller for charging the image supporting member; and a cleaning member for cleaning the surface of the charging roller. The charging roller has a surface, and the surface has irregularity oriented in a direction opposite to a direction that the cleaning member slides against the charging roller. Further, the surface has a maximum peak height Rp within a range of 2 μm≦Rp≦10 μm, and an average profile length RSm within a range of 40 μm≦RSm≦200 μm.

4 Claims, 6 Drawing Sheets

CHARGING DEVICE HAVING CHARGING ROLLER WITH SPECIFIC CHARACTERISTIC AND IMAGE FORMING APPARATUS

BACKGROUND OF THE INVENTION

1. Field of the Invention

The present invention relates to a charging device and an image forming apparatus.

2. Description of Related Art

A conventional electro-photographic image forming apparatus such as a printer, a copier, a fax machine, and a multi-function machine thereof forms an image through the following process. In a case of, for example, the printer, a surface of a photosensitive drum or an image supporting member is charged with a charging roller. Then, an LED head exposes the surface of the photosensitive drum to form a latent image. A developing roller electrostatically attaches a thin layer of toner to the latent image to form a toner image; and a transfer roller transfers the toner image to a sheet, thereby forming an image or printing. After transferring the toner image, a cleaning blade cleans toner remaining on the photosensitive drum. Afterward, the sheet with the toner image transferred thereon is sent to a fixing device, thereby fixing the toner image to the sheet.

When the printer with the above-described structure continuously performs the printing operation, the surface of the photosensitive drum may not be completely cleaned with a cleaning blade. In this case, remaining toner, exterior additive, sheet powder, and so on may adhere on the surface of the charging roller.

To solve this problem, it has been proposed to provide a charging device having a cleaning blade, so that toner, exterior additive, sheet powder and so on, which adhere onto the charging roller surface, can be scraped off.

However, in such a conventional charging device, when the cleaning member does not sufficiently scrape off toner, exterior additive, and so on due to a reduced size of toner particles or longer duration of the apparatus, toner, exterior additive, and so on adhering to the surface of the charging roller tend to form a film covering the surface. Accordingly, it is difficult to uniformly charge the photosensitive drum, thereby deteriorating image quality.

In view of the problems described above, an object of the invention is to provide a charging device and an image forming apparatus, which can uniformly charge an image supporting member and thereby can prevent quality loss, while solving the above problems of the conventional charging device.

Further objects and advantages of the invention will be apparent from the following description of the invention.

SUMMARY OF THE INVENTION

In order to attain the objects described above, according to the present invention, a charging device includes a charging roller and a cleaning member for cleaning a surface of the charging roller. The charging roller has the surface having a specific size of irregularity in a specific direction.

According to the invention, the irregularity of the charging roller surface may be oriented in a direction opposite with respect to the cleaning member. An average surface roughness of the charging roller may have a maximum peak height Rp of at least 2 μm and equal to or less than 10 μm, and an average profile length RSm of at least 40 μm and equal to or less than 200 μm.

Accordingly, it is possible to uniformly charge the image supporting member with the charging device, thereby improving image quality. As a result, the charging roller becomes more durable, and the durability of the charging device and the image forming apparatus can be improved.

DETAILED DESCRIPTION OF PREFERRED EMBODIMENTS

Hereunder, embodiments of the present invention will be explained with reference to the accompanying drawings. In the description below, embodiments are described regarding a printer as an image forming apparatus.

Figure 2:
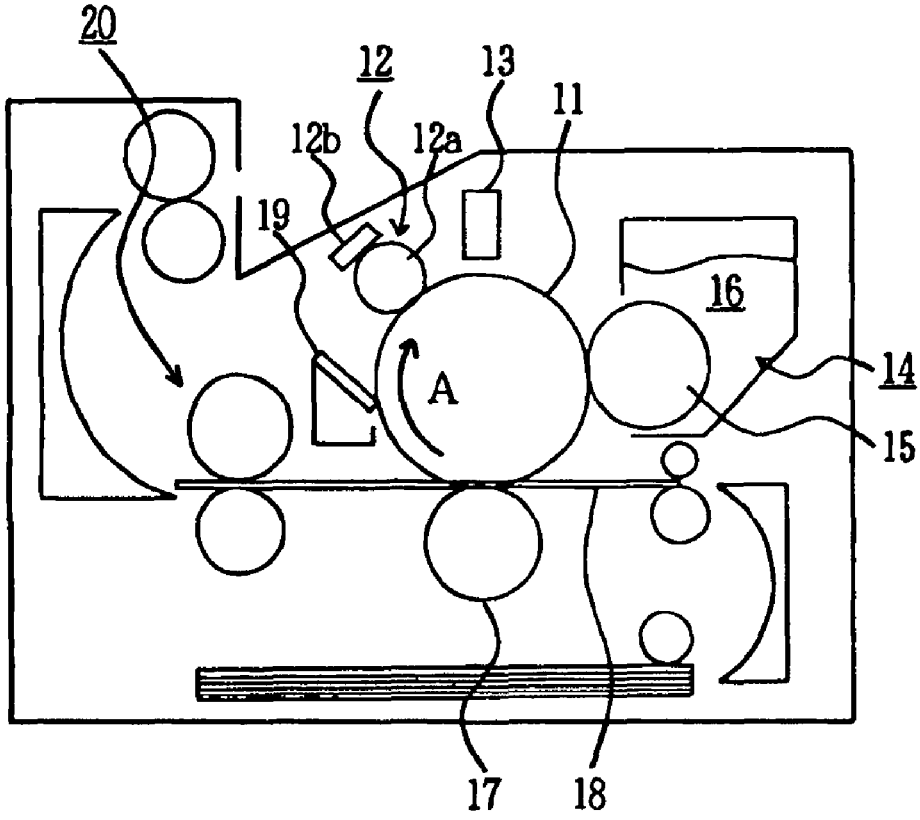
FIG. 2 is a schematic view showing a printer according to the first embodiment of the present invention.

FIG. 2 is a schematic view showing a printer according to the first embodiment of the present invention. As shown in FIG. 2, the printer includes a photosensitive drum 11 or a cylindrical image supporting member disposed to be freely rotatable. A charging device 12 is provided adjacent to the photosensitive drum 11 so as to uniformly and evenly charge the photosensitive drum surface. Once the photosensitive drum surface is charged with the charging device 12, a LED head 13 as an exposure device irradiates light so that the photosensitive drum surface is exposed to the light, and an electrostatic latent image is formed.

Then, toner 16 as a developer is fed onto the electrostatic latent image, and a toner image is formed to a developed image by a developing device 14 on the photosensitive drum surface. A transfer roller 17 as a transferring device transfers the toner image formed on the photosensitive drum surface onto a sheet. A cleaning blade 19 as a cleaning device scrapes off toner remaining on the photosensitive drum surface after transferring the toner image, and also scrapes off sheet powder and the like adhering to the photosensitive drum 11 during the image transfer. A fixing device 20 fixes the toner image transferred onto the sheet.

The developing device 14 has a developing roller 15 or a developer supporting member provided so as to contact with the photosensitive drum 11. The charging device 12 has a freely rotatable charging roller 12*a*, and a cleaning member 12*b* attached to a main body of the apparatus. When a voltage is applied onto the charging roller 12*a* from a power source (not illustrated), the surface of the photosensitive drum 11 is uniformly and evenly charged. Here, the printer comprises the charging device 12, the photosensitive drum 11, the LED head 13, the developing device 14, the transfer roller 17, and the fixing device 20.

When printing data is sent to the printer with the above-described constitution, a sheet 18 is fed from a sheet tray or a print medium feeder. Then, the sheet 18 is sent to between the photosensitive drum 11 and the transfer roller 17. At this time, the toner image is transferred to the sheet 18, fixed by the fixing device 20, and then discharged outside the printer.

To form the toner image, the photosensitive drum 11 starts rotating in the direction of arrow A (clockwise). With the rotation, the surface of the photosensitive drum 11 is charged by the charging roller 12*a*, which rotates with the photosensitive drum 11 while contacting with the photosensitive drum surface. About −1,100 V of a direct current voltage is applied from a power source (not illustrated) to the charging roller 12*a*, and the surface potential of the photosensitive drum 11 becomes about −600 V.

Then, the charged photosensitive drum surface is exposed to light irradiated from the LED head 13 corresponding to the printing data, and the potential of the exposed portion becomes 0 to −300 V, so that an electrostatic image is formed. The developing device 14 attaches toner to the electrostatic latent image, so that a toner image is formed. The toner image is transferred to sheet 18 by the transfer roller 17.

After transferring the image to the sheet 18, toner and exterior additive remaining on the photosensitive drum surface, sheet powder adhering to the photosensitive drum surface at the time of image transfer, and so on are removed by the cleaning blade 19. Then, the surface of the photosensitive drum 11 is again charged by the charging roller 12*a*.

In some cases, toner, external additives, sheet powder so on, which adhere on the charging roller surface, may not be completely removed by the cleaning blade 19, and remain on the surface. Accordingly, toner, additives, sheet powder and so on, which adhere on the surface of the charging roller 12*a*, are scraped off by slidingly contacting with the cleaning member 12*b*.

However, because of a reduced size of toner particles and longer toner life, and other factors, when toner, external additive and so on, which adhere on the surface of the charging roller 12*a*, increase and cannot be fully removed from the surface with the cleaning member 12*b*, the un-scraped and remaining substances tend to form a film on the surface. As a result, the surface of the photosensitive drum 11 cannot be uniformly charged, and the image quality becomes impaired. Therefore, in the embodiment, the charging roller 12*a* surface has a specific irregularity profile.

Figure 1:
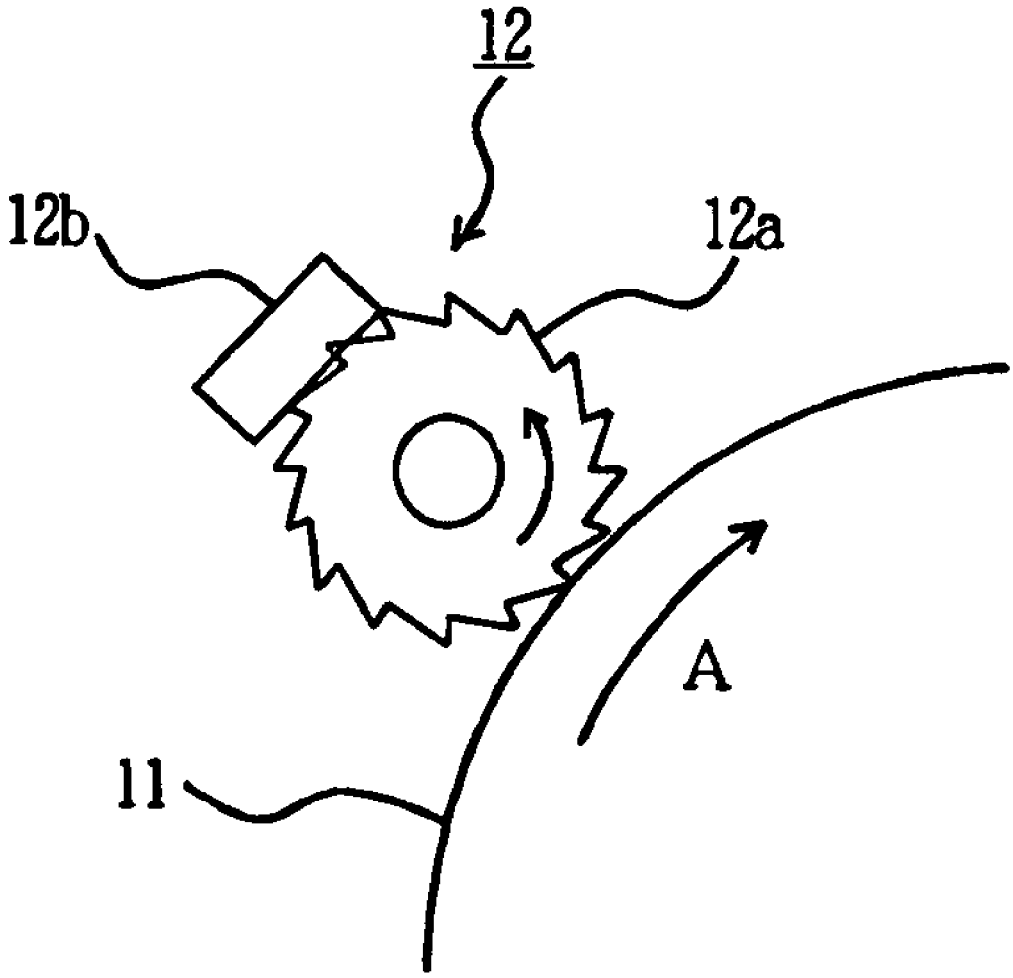
FIG. 1 is a schematic view showing a charging device according to a first embodiment of the present invention.

FIG. 1 is a schematic view showing a charging device according to a first embodiment of the present invention. As shown in FIG. 1, the charging device 12 comprises the charging roller 12*a* and the cleaning member 12*b*. The charging roller 12*a* is provided so as to press or tightly contact with the photosensitive drum 11, and rotates being driven by the rotation of the photosensitive drum 11.

In the charging roller 12*a*, an electroconductive elastic layer is formed on an outer circumferential surface thereof except both edges of a core rod thereof made of an electroconductive material. For the core rod, a metal shaft formed of SUM (Steel Use Machinability) plated with nickel through electro-less plating thereon is used. The elastic layer has a volume resistivity [Ω·cm] within a area Between $10^5$ and $10^{11}$ Ω·cm, and is formed as a resistive layer. The resistivity of the elastic layer can be adjusted through an amount of an electroconductive additive.

The elastic layer may be made of rubber, thermoplastic elastomer, and the likes. For example, the elastic layer may be made of a rubber composition that essentially contains one or more types of rubbers, such as chloroprene rubber (CR), epichlorohydrin rubber (CO, ECO, GECO), ethylene propylene rubber (EPM, EPDM), urethane rubber, silicone rubber, and nitrile rubber (NBR).

In the embodiment, the elastic layer has an outer surface having specific polishing marks and a specific surface roughness formed through a machining process or a polishing process. After the machining process or the polishing process, even if the outer surface is treated or coated, the outer surface still has specific polishing marks and a specific surface roughness. The surface treatment, coating, and so on can be performed on one layer or more layers. For example, the surface can be impregnated with isocyanate, polyol, or the like, or can be coated with polyester resin, urethane resin, acrylic urethane resin, epoxy resin, nylon resin, fluororesin, silicone resin and so on. Furthermore, by adding an electroconductive additive to a surface treatment agent or a coating agent, electroconductivity can be provided or resistance can be adjusted.

The cleaning member 12*b* is disposed so as to always press against the charging roller 12*a*. When the charging roller 12*a* rotates, the cleaning member 12*b* is secured in the main body of the printer so as to slidingly contact with the charging roller surface. The cleaning member 12*b* is made of a foamed material such as sponge, a brush-like material, or felt and other material.

Figure 3:
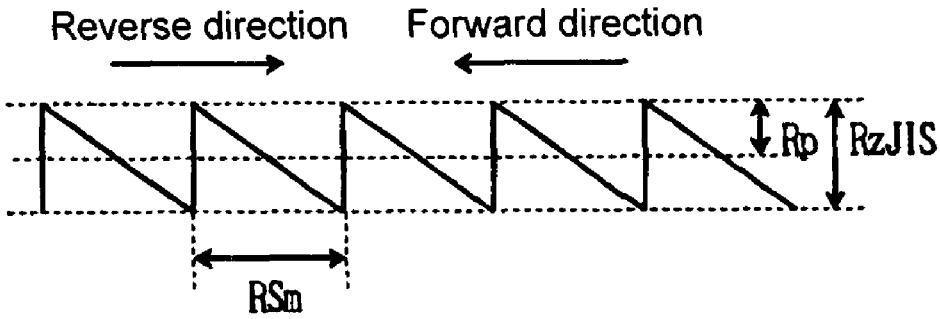
FIG. 3 is a schematic view No. 1 showing a surface roughness profile of a charging roller according to the first embodiment of the present invention.
Figure 4:
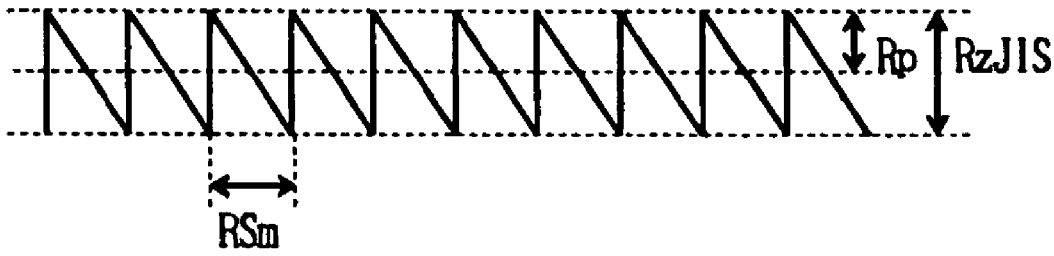
FIG. 4 is a schematic view No. 2 showing the surface roughness profile of the charging roller according to the first embodiment of the present invention.
Figure 5:
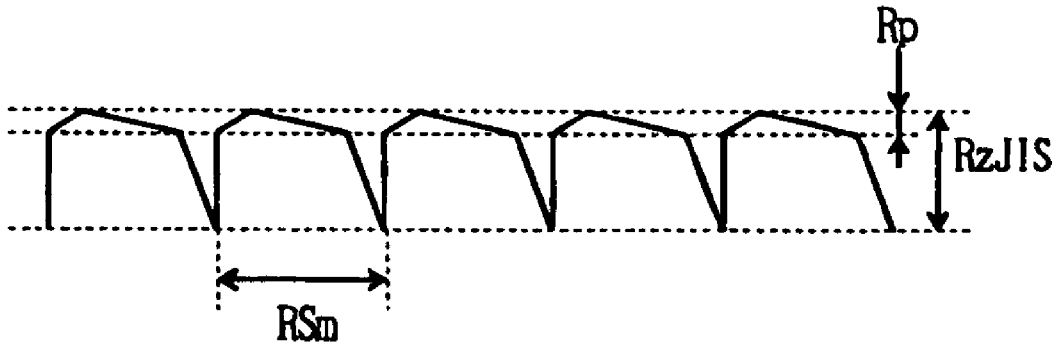
FIG. 5 is a schematic view No. 3 showing the surface roughness profile of the charging roller according to the first embodiment of the present invention.
Figure 6:
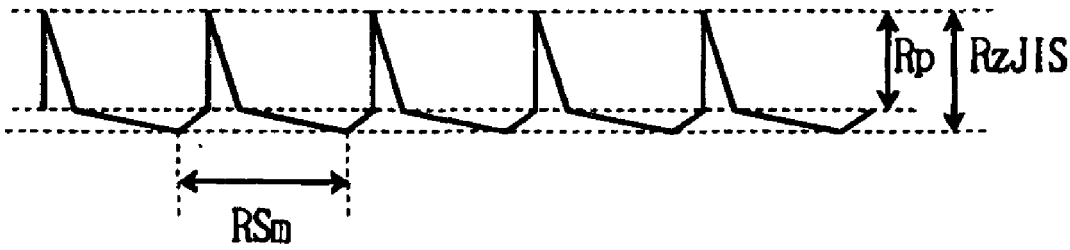
FIG. 6 is a schematic view No. 4 showing the surface roughness profile of the charging roller according to the first embodiment of the present invention.

The charging roller 12*a* will be described in more detail next. FIG. 3 is a schematic view No. 1 showing a surface roughness profile of the charging roller 12*a* according to the first embodiment of the present invention. FIG. 4 is a schematic view No. 2 showing the surface roughness profile of the charging roller 12*a* according to the first embodiment of the present invention. FIG. 5 is a schematic view No. 3 showing the surface roughness profile of the charging roller 12*a* according to the first embodiment of the present invention. FIG. 6 is a schematic view No. 4 showing the surface roughness profile of the charging roller 12*a* according to the first embodiment of the present invention.

In the embodiment, the polishing marks on the surface of the charging roller 12*a* (FIG. 1) are oriented in a direction according to a direction of machining and so on in the machining process or the polishing process. As shown in FIG. 3, with regard to the orientation of an irregularity profile of the surface of the charging roller 12*a*, "forward direction" represents a direction in which the friction against the cleaning member 12*b* becomes smaller when the charging roller 12*a* rotates, and "opposite direction" represents a direction, in which the friction becomes larger when the charging roller 12*a* rotates.

A surface condition of the charging roller 12*a* varies by fabricating conditions, such as machining, polishing surface treatment, and coating. FIGS. 3 to 6 show examples of the surface profiles of the charging roller 12*a* under an assumption that the surface profiles have a ten-point average roughness Rz (JIS) at a same level. In general, it is difficult to determine a difference in surface states simply from the ten-point average roughness Rz (JIS). Accordingly, as shown FIGS. 3 to 6, the difference in surface states is evaluated from other surface roughness parameters other than the ten-point average roughness Rz (JIS).

For example, the surface profiles shown in FIGS. 3 and 4 have the ten-point average roughness Rz (JIS) at the same level. However, it is possible to distinguish the surface profiles shown in FIGS. 3 and 4 from another surface roughness parameters such as an average profile length RSm and a root-mean-square slope RΔq. In this case, the surface profile shown in FIG. 3 shows the average profile length RSm larger than that in FIG. 4.

Further, it is possible to distinguish the surface profiles shown in FIGS. 5 and 6 from such surface roughness parameters as a maximum peak height Rp, a maximum profile valley depth Rv, a skewness Rsk, and a load length ratio Rmr(c). In this case, the surface profile shown in FIG. 5 shows the maximum peak height Rp smaller than that FIG. 6.

The charging roller 12*a* rotates contacting or being adjacent to the photoconductive drum 11, and charges the surface of the photosensitive drum 12*a*. At this time, the profile peaks of the polishing marks of the charging roller 12*a* charges the photosensitive drum 11, and the valley portions thereof hardly contribute to the charging. Therefore, by controlling the peak heights and the peak intervals on the surface of the charging roller 12*a*, the charging performance can be controlled.

As shown in FIG. 1, the charging roller 12*a* slidingly contacts with the cleaning member 12*b* so that the direction of the profile irregularity of the surface is the opposite direction with respect to the cleaning member 12*b*, not the forward direction. Accordingly, it is possible to strongly press the cleaning member 12*b* against the profile peaks of the charging roller 12*a*, thereby improving cleaning efficiency.

First Embodiment

In a first embodiment of the present invention, the charging roller 12*a* is formed of the core bar or a metal shaft made of SUM 23 plated with nickel through the electro-less plating and having an outer diameter of 6.0 mm. The conductive elastic layer is machined and polished to have an outer diameter of 12.0 mm, so that the direction of the surface profile irregularity becomes the opposite direction with respect to the cleaning member 12*b* of the charging device 12 when the charging roller 12*a* is disposed in the charging device 12.

The conductive elastic layer is formed of a rubber essentially containing chloroprene rubber, and a surface thereof is treated through impregnating in isocyanate and polycarbonate polyol. The charging roller 12*a* has a surface hardness of 68° measured using a micro durometer MD-1 Type A (manufactured by Kobunshi Keiki Co., Ltd.). In the embodiment, the charging roller 12*a* has the surface profile having various levels of the maximum profile peak height (Rp) and the average length (RSm).

In the embodiment, the cleaning member 12*b* is formed of a urethane sponge of a polyester type. The sponge has a hardness of 20° or less measured using an ASKER C durometer, and a sponge surface having the number of cells of about 40 cells/25 mm. The cleaning member 12*b* has a thickness of 2.0 mm, and is always pressed against the charging roller 12*a* with a nip width of 3.0 mm.

In the embodiment, in the urethane sponge of the cleaning member 12*b*, un-foamed urethane of the polyester type (before foamed) has a surface hardness of 73° measured using the micro durometer MD-1 Type A (manufactured by Kobunshi Keiki Co., Ltd.), which is larger than that of the surface of the charging roller 12*a*.

Figure 7:
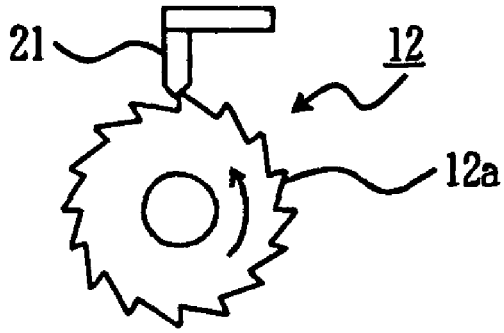
FIG. 7 is a schematic view showing a method of measuring the surface roughness according to the first embodiment of the present invention.

In the embodiment, the surface roughness parameters of the charging roller 12*a* were measured according to the following method. FIG. 7 is a schematic view showing a method of measuring the surface roughness according to the first embodiment of the present invention.

As shown in FIG. 7, in the measurement, a stylus 21 contacted with the surface of the charging roller 12*a*. Further, a surface roughness meter SE-3500 (manufactured by Kosaka Laboratory Ltd.), a detector PU-DJ2S (manufactured by Kosaka Laboratory Ltd.), a circumferential roughness measuring device SRM-200 (manufactured by Kosaka Laboratory Ltd.), and so on were used for the measurement. In the measurement, when the charging roller 12*a* rotated in an arrow direction (counterclockwise) in FIG. 7, it was arranged such that the surface irregularity of the charging roller 12*a* was oriented in a direction opposite to the stylus 21, similar to the case that the charging roller 12*a* slides against the cleaning member 12*b* (refer to FIG. 1).

As for measurement conditions, according to a roughness profile measurement method of JIS B0601:2001, a cutoff λc was 0.8 mm, a standard length was 0.8 mm, a measuring length was 4.0 mm, and a feeding speed was 0.1 mm/s. In the measurement, a plurality of rollers was used. In each roller, three points on the roller along the longitudinal direction and three points on the roller along the circumferential direction were selected, so that the measurement was performed on the nine points on the roller. An average of the nine points was calculated.

In the measurement, the printer included the photosensitive drum having the outer diameter of 30 mm and the surface with a layer containing polycarbonate formed thereon. The photosensitive drum rotated during printing at a rotational speed of 120 rpm. A voltage of about −1,050 V was applied to the charging roller 12*a*. The charging roller 12*a* was provided so as to contact with the photosensitive drum 11 and rotate as the photosensitive drum 11 rotated.

In the measurement, the printer having the charging device 12 of the above-described structure performed a print test for evaluating image quality. Further, an electric potential on the surface of the photosensitive drum 11 was measured. In the print test, approximately 50,000 A4 size sheets 18 were supplied longitudinally for printing, and the print test was performed at every 1,000-th sheet for evaluating the image quality. An image pattern for the evaluation included a white area having a page coverage rate of 1%, a halftone area having the page coverage rate of 20%, and a halftone area having the page coverage rate of 50%.

In the evaluation of the image quality, each image pattern was evaluated by visual observation in comparison with a reference sample. The reference sample was an image having a minimum acceptable level for such characteristics as longitudinal black streak, vertical black streak, longitudinal white streak, vertical white streak, vertical band, longitudinal band, uniformity of density, and so on.

In the evaluation of the image quality, a trained inspector visually conducted a sensory test. When an image obtained in the print test was worse than the reference sample, or when the image quality obtained in the print test was almost similar to the reference sample and it was difficult to evaluate the difference from the reference sample, it was judged that the charging roller 12*a* failed the print test. When the image quality obtained in the print test is better than the reference sample, it was judged that the charging roller 12*a* passed the test.

In the potentiometer measurement, a potential on the surface of the photosensitive drum 11 was measured before and after the print test. When the electric potential was measured, a temperature was set 25° C., humidity was set 50%, and a voltage applied to the charging roller 12*a* was set −1,050 V. When a difference Δv1 between average values of the surface potential of the photosensitive drum 11 before and after the print test was not greater than 30 V, it is determined that the charging roller 12*a* was judged as "Passed". Further, in addition to the above condition, when a difference Δv2 between maximum and the minimum values, which indicated a variance of the surface potential of the photosensitive drum 11 after the print test, was not larger than 30 V, the charging roller 12*a* was judged as "Passed". When the difference Δv1 is larger than 30 V or the difference Δv2 is larger than 30 V, the charging roller 12*a* was judged as "Failed".

Figure 8:
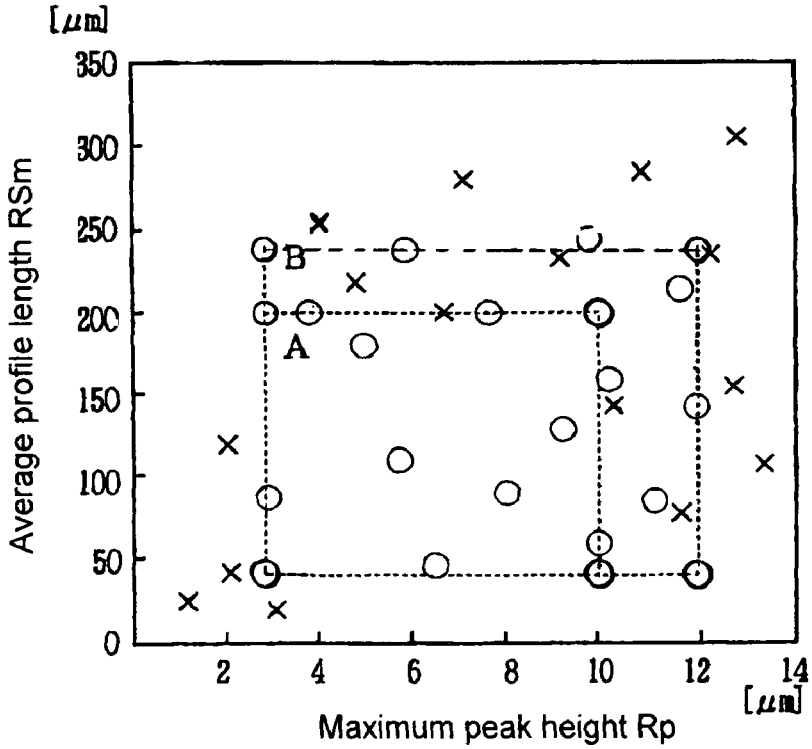
FIG. 8 is a graph showing results of a printing test and a potentiometer test of the charging roller according to the first embodiment of the present invention.

FIG. 8 is a graph showing results of the printing test and the potentiometer test of the charging roller 12*a* according to the first embodiment of the present invention. In FIG. 8, the abscissa represents the maximum peak height of the roughness profile (Rp) of the charging roller 12*a* (FIG. 1), and the ordinate represents the average profile width (RSm).

In FIG. 8, "○" indicates that the charging roller 12*a* passed the print test and the potentiometer test, and "x" indicates that the charging roller 12*a* failed in at least one of the print test and the potentiometer test.

The results with respect to the maximum peak height Rp and the mean width RSm are also shown in Table 1.

TABLE 1

| | Passed | | Failed | |
|---|---|---|---|---|
| | Maximum peak height Rp (μm) | Average profile length RSm (μm) | Maximum peak height Rp (μm) | Average profile length RSm (μm) |
| A | 3.0 | 93 | 0.9 | 28 |
| | 3.0 | 40 | 1.8 | 42 |
| | 3.0 | 200 | 2.0 | 129 |
| | 5.1 | 177 | 2.8 | 22 |
| | 5.9 | 118 | 4.3 | 249 |
| | 6.3 | 44 | 7.4 | 274 |
| | 7.7 | 200 | 10.8 | 272 |
| | 7.8 | 99 | 7.4 | 274 |
| | 9.2 | 141 | 12.2 | 238 |
| | 10.0 | 61 | 12.7 | 174 |
| | 10.0 | 40 | 12.9 | 296 |
| | 10.0 | 200 | 13.3 | 115 |
| B | 3.0 | 240 | 4.9 | 217 |
| | 3.8 | 205 | 6.9 | 205 |
| | 6.0 | 233 | 9.5 | 223 |
| | 9.9 | 240 | 10.3 | 156 |
| | 10.4 | 173 | 11.5 | 91 |
| | 11.0 | 96 | | |
| | 11.4 | 216 | | |
| | 12.0 | 156 | | |
| | 12.0 | 240 | | |
| | 12.0 | 50 | | |

As shown in FIG. 8, it is found that the charging roller 12*a* passed (indicated by ○ in FIG. 8) in both the print test and the potentiometer test in an area A indicated by a hidden line. In the area A, the maximum peak height Rp is at least 3 μm and equal to or less than 10 μm, and the average profile length RSm is at least 40 μm, and equal to or less than 200 μm.

Further, it is found that the charging roller 12*a* either passed or failed (indicated by x in FIG. 8) in the print test and the potentiometer test in an area B indicated by a hidden line. In the area B, the maximum peak height Rp is larger than 10 μm and equal to or less than 12 μm, and the average profile length RSm is at least 40 μm and equal to or less than 240 μm, or the maximum peak height Rp is at least 3 μm and equal to or less than 12 μm and the average profile length RSm is larger than 200 μm and equal to or less than 240 μm.

The area B can be considered as a gray zone, where it is difficult to judge "Pass" or "Fail" by measuring only the maximum peak height Rp and the average profile length RSm. Accordingly, in the first embodiment, the charging roller 12*a* only in the area A is selected, and the charging roller 12*a* in the gray zone is not selected.

When the charging roller 12*a* has the maximum peak height Rp smaller than 3 μm, it is found that the charging roller 12*a* failed in both the test print result and the potentiometer test, regardless of the average profile length RSm. This is because the charging roller 12*a* has the surface with less irregularity and the cleaning member 12*b* damages the surface of the charging roller 12*a*, thereby deteriorating print quality due to vertical streaks and the like on an image.

Similarly, when the charging roller 12*a* has the maximum peak height Rp larger than 12 μm, the charging roller 12*a* failed in both the print test and the potentiometer test, regardless of the average profile width Sm. This is because the charging roller 12*a* has the surface having irregularity filled with toner, exterior additive, and so on, so it is difficult to completely clean the surface of the charging roller 12*a*, thereby creating a film on the surface of the charging roller 12*a*. As a result, the photoconductive drum 11 is charged with fluctuated potentials, thereby causing a lateral streak and uneven density in an image.

Furthermore, when the charging roller 12*a* has the average profile length RSm smaller than 4 μm, the charging roller 12*a* failed both in the print test and the potentiometer test, regardless of the maximum peak height Rp. This is because the charging roller 12*a* has the surface having irregularity with a small interval, so it is difficult to completely clean the surface of the charging roller 12*a*, thereby creating a film on the surface of the charging roller 12*a*. As a result, the photoconductive drum 11 is charged with fluctuated potentials, thereby causing a lateral streak and uneven density in an image.

When the charging roller 12*a* has the average profile length RSm smaller than 3 μm, it was found that the charging roller 12*a* failed in both the test print result and the potentiometer test, regardless of the maximum peak height Rp. This is because the charging roller 12*a* has the surface having irregularity with a large interval and the cleaning member 12*b* easily damages the surface of the charging roller 12*a*, thereby deteriorating print quality due to vertical streaks and the like on an image. Further, the photoconductive drum 11 is charged with fluctuated potentials, thereby causing a lateral streak and uneven density in an image.

As described above, in the embodiment, it is arranged such that the charging roller 12*a* has the surface roughness controlled with respect to the maximum peak height Rp and the average profile length RSm. Accordingly, it is possible to surely prevent a film from forming on the surface of the charging roller 12*a*, and the image quality can be stabilized by uniformly charging the photosensitive drum 11. Furthermore, since the photosensitive drum 11 can be stably charged, the charging roller 12*a* becomes highly durable, and the durability of the charging device 12 and the printer can be also improved.

In the embodiment, the cleaning member 12*b* is formed of the urethane sponge of the polyester type, and un-foamed urethane of the urethane sponge (before foamed) has a surface hardness of 73°, which is larger than that of the surface of the charging roller 12*a*. That is, the urethane sponge of the cleaning member 12*b* has a surface hardness measured using the micro durometer MD-1 Type A (manufactured by Kobunshi Keiki Co., Ltd.), which is larger than that of the surface of the charging roller 12*a*. In the embodiment, it is suffice that the urethane sponge of the cleaning member 12*b* has a surface hardness larger than 68°.

Second Embodiment

A second embodiment of the present invention will be described below. Components in the second embodiment similar to those in the first embodiment are designated by the same reference numerals, and explanations thereof are omitted. The components in the second embodiment similar to those in the first embodiment provide effects similar to those in the first embodiment.

In the second embodiment, the charging roller 12*a* has a structure different from that in the first embodiment, and the cleaning member 12*b* is formed of a sponge made of a butyl type rubber composition. The sponge has hardness of about 25° measured with an ASKER C durometer, and a surface with the number of cells of about 80 cells/25 mm. With respect to the sponge of the cleaning member 12*b*, an un-foamed of the butyl type rubber composition has a surface hardness of 56° measured using the micro durometer MD-1 Type A (manufactured by Kobunshi Keiki Co., Ltd.), which is smaller than that of the surface of the charging roller 12*a* formed of the butyl type rubber composition.

In the first embodiment, the cleaning member 12*b* is formed of the urethane sponge of the polyester type having high durable and a hardness large than the surface of the charging roller 12*a*. On the other hand, in the second embodiment, the cleaning member 12*b* is formed of the sponge of the rubber type having the hardness smaller than the surface of the charging roller 12*a*.

An evaluation of the charging roller 12*a* and the cleaning member 12*b* was conducted in the method same as that in the first embodiment.

Figure 9:
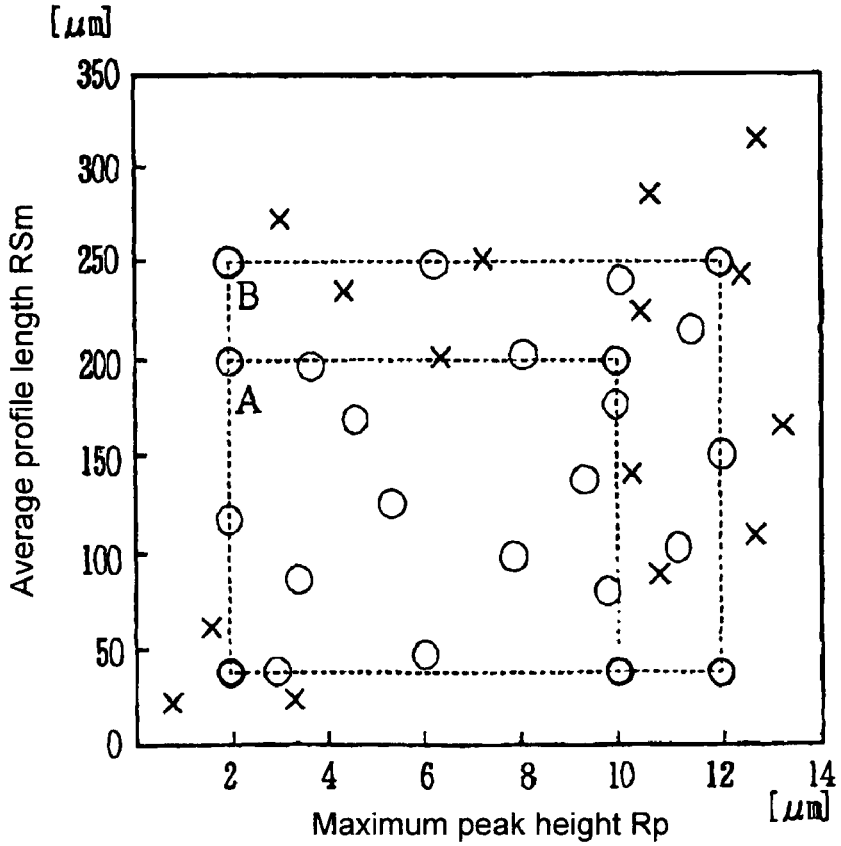
FIG. 9 is a graph showing results of a printing test and a potentiometer test of a charging roller according to a second embodiment of the present invention.

FIG. 9 is a graph showing results of a printing test and a potentiometer test of a charging roller according to a second embodiment of the present invention. In FIG. 9, the abscissa represents the maximum peak height Rp of the charging roller 12*a* (refer to FIG. 1), and the ordinate represents the average profile length RSm.

Similar to the first embodiment, in FIG. 9, "○" indicates that the charging roller 12*a* passed the print test and the potentiometer test, and "x" indicates that the charging roller 12*a* failed in at least one of the print test and the potentiometer test.

The results with respect to the maximum peak height Rp and the mean width RSm are also shown in Table 2.

TABLE 2

| | Passed | | Failed | |
|---|---|---|---|---|
| | Maximum peak height Rp (μm) | Average profile length RSm (μm) | Maximum peak height Rp (μm) | Average profile length RSm (μm) |
| A | 2.0 | 129 | 0.8 | 24 |
| | 2.0 | 40 | 1.7 | 62 |
| | 2.0 | 200 | 3.3 | 25 |
| | 3.0 | 40 | 3.4 | 277 |
| | 3.4 | 107 | 7.4 | 255 |
| | 3.8 | 200 | 10.5 | 280 |
| | 5.1 | 177 | 12.3 | 243 |
| | 5.7 | 130 | 12.6 | 110 |
| | 6.0 | 52 | 12.8 | 302 |
| | 7.6 | 111 | 13.3 | 167 |
| | 9.2 | 141 | | |
| | 9.9 | 78 | | |
| | 10.0 | 173 | | |
| | 10.0 | 200 | | |
| | 10.0 | 40 | | |
| B | 2.0 | 250 | 4.9 | 217 |
| | 6.2 | 250 | 6.9 | 205 |
| | 8.1 | 209 | 9.5 | 223 |
| | 9.8 | 241 | 10.3 | 156 |
| | 11.3 | 101 | 11.5 | 91 |
| | 11.4 | 216 | | |
| | 12.0 | 160 | | |
| | 12.0 | 250 | | |
| | 12.0 | 40 | | |

As shown in FIG. 9, it is found that the charging roller 12*a* passed (indicated by ○ in FIG. 9) in both the print test and the potentiometer test in an area A indicated by a hidden line. In the area A, the maximum peak height Rp is at least 2 μm and equal to or less than 10 μm, and the average profile length RSm is at least 40 μm, and equal to or less than 200 μm.

As opposed to the first embodiment, a minimum level of the maximum peak height Rp slightly extends to 2 μm in the second embodiment. This is because the cleaning member 12*b* is formed of the rubber composition having the hardness smaller than that of the surface of the charging roller 12*a*. Accordingly, as opposed to the first embodiment, the cleaning member 12*b* does damage the surface of the charging roller 12*a* to a less extent.

Further, it is found that the charging roller 12*a* either passed or failed (indicated by x in FIG. 9) in the print test and the potentiometer test in an area B indicated by a hidden line. In the area B, the maximum peak height Rp is larger 10 μm and equal to or less than 12 μm, and the average profile length RSm is at least 40 μm and equal to or less than 250 μm, or the maximum peak height Rp is at least 2 μm and equal to or less than 12 μm and the average profile length RSm is greater 200 μm and equal to or less than 250 μm.

Similar to the first embodiment, the area B can be considered as a gray zone, where it is difficult to judge "Pass" or "Fail" by measuring only the maximum peak height Rp and the average profile length RSm. Accordingly, in the second embodiment, the charging roller 12*a* only in the area A is selected, and the charging roller 12*a* in the gray zone is not selected.

As described above, in the embodiment, it is arranged such that the charging roller 12*a* has the surface roughness controlled with respect to the maximum peak height Rp and the average profile length RSm. Further, the cleaning member 12*b* is formed of the sponge. Accordingly, it is possible to prevent damage on the surface of the charging roller 12*a* and a film from forming in the area larger than that in the first embodiment. Further, it is possible to reduce a noise due to friction between the cleaning member 12*b* and the charging roller 12*a*.

In the embodiment, the cleaning member 12*b* is formed of the sponge of the butyl type rubber composition, and the un-foamed sponge (before foamed) has the surface hardness of 56° that is smaller than the surface hardness of 68° of the charging roller 12*a*.

It is noted that when the un-foamed sponge (before foamed) has a surface hardness of 68° measured using the micro durometer MD-1 Type A (manufactured by Kobunshi Keiki Co., Ltd.), which is the same as that of the surface of the charging roller 12*a*, the cleaning member 12*b* shows cleaning performance same as that in the case of the surface hardness of 56°.

Accordingly, in the embodiment, it is suffice that the un-foamed sponge (before foamed) has a surface hardness equal to or smaller than that of the surface of the charging roller 12*a*. For example, in the embodiment, the un-foamed sponge (before foamed) has a surface hardness equal to or smaller than 68°.

When the un-foamed sponge (before foamed) has a too small surface hardness, it is difficult to obtain a sufficient number of cells when foamed, thereby easily deforming and deteriorating cleaning performance. Accordingly, in the embodiment, the un-foamed sponge (before foamed) preferably has a surface hardness larger than 40° measured using the micro durometer MD-1 Type A (manufactured by Kobunshi Keiki Co., Ltd.). When the un-foamed sponge (before foamed) has a surface hardness smaller than 40°, it is difficult to obtain sufficient cleaning performance.

Third Embodiment

A third embodiment of the present invention will be described below. Components in the third embodiment similar to those in the first and second embodiments are designated by the same reference numerals, and explanations thereof are omitted. The components in the third embodiment similar to those in the first and second embodiments provide effects similar to those in the first and second embodiments.

In the third embodiment, the results of the print test and potentiometer test in the area B in the first embodiment shown in FIG. 8 are investigated. As described above, in the area B indicated by the hidden line in FIG. 8, the maximum peak height Rp is larger 10 μm and equal to or less than 12 μm, and the average profile length RSm is at least 40 μm and equal to or less than 240 μm, or the maximum peak height Rp is at least 3 μm and equal to or less than 12 μm and the average profile length RSm is greater 200 μm and equal to or less than 240 μm.

In the embodiment, the surface roughness of the charging roller 12*a* was measured using measurement conditions (referred to as conditions No. 2) different from those (referred to as conditions No. 1) in the first embodiment. Then, results measured under the conditions No. 2 are compared with those measured under the conditions No. 1.

That is, under the conditions No. 1, the cutoff λc was 0.8 mm, the standard length was 0.8 mm, the measuring length was 4.0 mm, and the feeding speed was 0.1 mm/s. The maximum peak height measured under the conditions No. 1 is referred to as Rp(a). Under the conditions No. 2, the cutoff λc was 2.5 mm, the standard length was 2.5 mm, the measuring length was 12.5 mm, and the feeding speed was 0.5 mm/s. The maximum peak height measured under the conditions No. 2 is referred to as Rp(b).

The surface roughness was measured before the print test. Similar to the first embodiment, the measurement of the surface roughness was conducted using the surface roughness meter SE-3500 according to the roughness profile measurement method of JIS B0601:2001.

It is noted that the maximum peak height represents a maximum value of mountains of the roughness profile within the standard length. Accordingly, when the standard length increases, the maximum peak height tends to increase. As described above, the standard length was 0.8 mm under the conditions No. 1, and the standard length was 2.5 mm under the conditions No. 2. Accordingly, the maximum peak height Rp(b) measured under the conditions No. 2 tends to be larger than the maximum peak height Rp(a) measured under the conditions No. 1.

Figure 10:
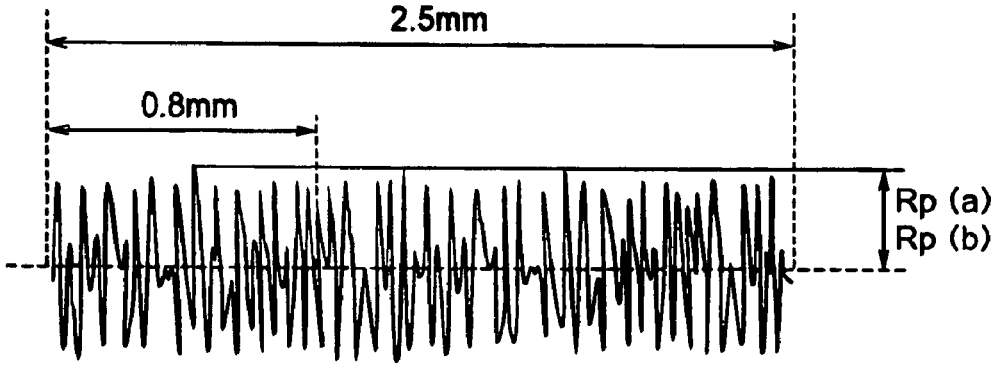
FIG. 10 is a graph showing a surface roughness of a charging roller measured under conditions No. 1 according to a third embodiment of the present invention.
Figure 11:
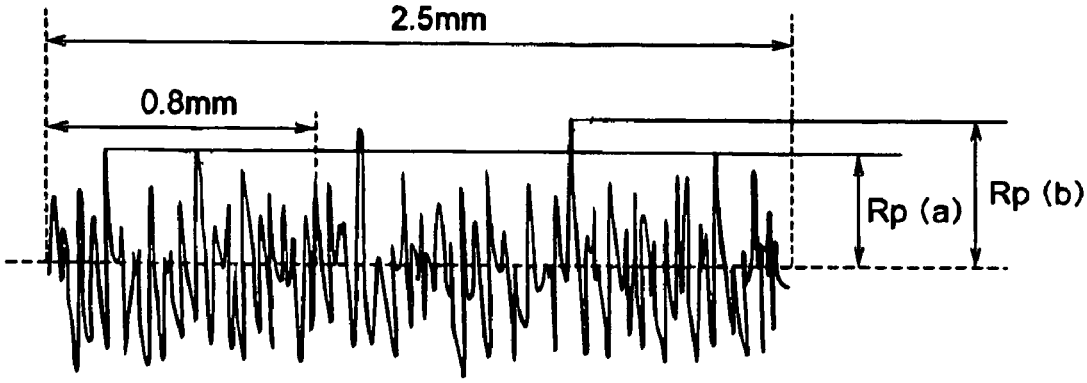
FIG. 11 is a graph showing a surface roughness of a charging roller measured under conditions No. 2 according to the third embodiment of the present invention.

FIG. 10 is a graph showing a surface roughness of a charging roller measured under the conditions No. 1 according to the third embodiment of the present invention. FIG. 11 is a graph showing a surface roughness of a charging roller measured under the conditions No. 2 according to the third embodiment of the present invention.

When the roughness profile shown in FIG. 10 is compared with that shown in FIG. 11, it is found that the roughness profile shown in FIG. 10 shows a smaller variance in the peak heights and a small difference between the maximum peak height Rp(a) and the maximum peak height Rp(b). On the other hand, it is found that the roughness profile shown in FIG. 11 shows a larger variance in the peak heights and a large difference between the maximum peak height Rp(a) and the maximum peak height Rp(b).

When a roughness parameter γ is defined as a result of the maximum peak height Rp(b) divided by the maximum peak height Rp(a), i.e., γ=Rp(b)/Rp(a), the surface roughness becomes more uniform when the roughness parameter γ approaches to 1.0, and the surface roughness becomes more irregular when the roughness parameter γ increases. The surface roughness of the charging roller 12*a* measured under the conditions No. 1 and No. 2 are shown in Table 3.

TABLE 3

| | Maximum peak height Rp (a) (μm) | Average profile length RSm (μm) | Maximum peak height Rp (b) (μm) | Roughness parameter Y |
|---|---|---|---|---|
| | | Passed | | |
| B | 3.0 | 240 | 3.5 | 1.17 |
| | 3.8 | 205 | 4.3 | 1.13 |
| | 6.0 | 233 | 6.6 | 1.10 |
| | 9.9 | 240 | 11.8 | 1.19 |
| | 10.4 | 173 | 12.2 | 1.17 |
| | 11.0 | 96 | 12.5 | 1.14 |
| | 11.4 | 216 | 13.7 | 1.20 |
| | 12.0 | 156 | 14.1 | 1.18 |
| | 12.0 | 240 | 14.4 | 1.20 |
| | 12.0 | 50 | 13.8 | 1.15 |

TABLE 3-continued

| Maximum peak height Rp (a) (μm) | Average profile length RSm (μm) | Maximum peak height Rp (b) (μm) | Roughness parameter Y |
|---|---|---|---|
| Failed | | | |
| 4.9 | 217 | 6.3 | 1.29 |
| 6.9 | 205 | 8.4 | 1.22 |
| 9.5 | 223 | 11.9 | 1.26 |
| 10.3 | 156 | 12.8 | 1.24 |
| 11.5 | 91 | 13.9 | 1.21 |

As shown in Table 3, it is found that the charging roller 12*a* either passed or failed in the print test and the potentiometer test in the area B shown in FIG. 8. In the area B shown in FIG. 8, the maximum peak height Rp is larger than 10 μm and equal to or less than 12 μm, and the average profile length RSm is at least 40 μm and equal to or less than 240 μm, or the maximum peak height Rp is at least 3 μm and equal to or less than 12 μm and the average profile length RSm is larger than 200 μm and equal to or less than 240 μm.

Further, it is found that the charging roller 12*a* passed when the roughness parameter γ is equal to or smaller than 1.2 (γ≦1.2), and the charging roller 12*a* failed when the roughness parameter γ is greater than 1.2 (γ>1.2).

When the roughness parameter γ is greater than 1.2, the surface roughness is irregular. Accordingly, it is difficult to uniformly press the cleaning member 12*b* against the charging roller 12*a*, so that a film is formed on the surface of the charging roller 12*a*, thereby making it difficult to stably charge the photosensitive drum 11 with the charging roller 12*a* and deteriorating image quality.

On the other hand, when the roughness parameter γ is equal to or smaller than 1.2, the surface roughness is regular. Accordingly, it is possible to uniformly press the cleaning member 12*b* against the charging roller 12*a*, so that a film is not formed on the surface of the charging roller 12*a*, thereby making it easy to stably charge the photosensitive drum 11 with the charging roller 12*a* and improving image quality. Further, it is possible to improve the durability of the charging roller 12*a*, the charging device 12, and the printer.

Fourth Embodiment

A fourth embodiment of the present invention will be described below. Components in the fourth embodiment similar to those in the first to third embodiments are designated by the same reference numerals, and explanations thereof are omitted. The components in the fourth embodiment similar to those in the first to third embodiments provide effects similar to those in the first and second embodiments.

In the fourth embodiment, the results of the print test and potentiometer test in the area B in the second embodiment shown in FIG. 9 are investigated. As described above, in the area B indicated by the hidden line in FIG. 9, the maximum peak height Rp is larger 10 μm and equal to or less than 12 μm, and the average profile length RSm is at least 40 μm and equal to or less than 250 μm, or the maximum peak height Rp is at least 2 μm and equal to or less than 12 μm and the average profile length RSm is greater 200 μm and equal to or less than 250 μm.

In the embodiment, the surface roughness of the charging roller 12*a* was measured using measurement conditions (referred to as conditions No. 2) different from those (referred to as conditions No. 1) in the second embodiment. Then, results measured under the conditions No. 2 are compared with those measured under the conditions No. 1.

That is, under the conditions No. 1, the cutoff λc was 0.8 mm, the standard length was 0.8 mm, the measuring length was 4.0 mm, and the feeding speed was 0.1 mm/s. The maximum peak height measured under the conditions No. 1 is referred to as Rp(a). Under the conditions No. 2, the cutoff λc was 2.5 mm, the standard length was 2.5 mm, the measuring length was 12.5 mm, and the feeding speed was 0.5 mm/s. The maximum peak height measured under the conditions No. 2 is referred to as Rp(b).

The surface roughness was measured before the print test. Similar to the first and second embodiments, the measurement of the surface roughness was conducted using the surface roughness meter SE-3500 according to the roughness profile measurement method of JIS B0601:2001. Also, similar to the third embodiment, the roughness parameter γ is defined as a result of the maximum peak height Rp(b) divided by the maximum peak height Rp(a), i.e., γ=Rp(b)/Rp(a).

The surface roughness of the charging roller 12*a* measured under the conditions No. 1 and No. 2 are shown in Table 4.

TABLE 4

| | Maximum peak height Rp (a) (μm) | Average profile length RSm (μm) | Maximum peak height Rp (b) (μm) | Roughness parameter Y |
|---|---|---|---|---|
| | Passed | | | |
| B | 2.0 | 250 | 2.3 | 1.15 |
| | 6.2 | 250 | 6.9 | 1.11 |
| | 8.1 | 209 | 9.1 | 1.12 |
| | 9.8 | 241 | 11.4 | 1.16 |
| | 11.3 | 101 | 12.6 | 1.12 |
| | 11.4 | 216 | 13.7 | 1.20 |
| | 12.0 | 160 | 14.0 | 1.17 |
| | 12.0 | 250 | 14.4 | 1.20 |
| | 12.0 | 40 | 13.5 | 1.13 |
| | Failed | | | |
| | 4.9 | 238 | 6.0 | 1.23 |
| | 6.5 | 205 | 8.2 | 1.27 |
| | 10.2 | 223 | 12.3 | 1.21 |
| | 10.4 | 139 | 12.5 | 1.21 |
| | 11.0 | 90 | 13.6 | 1.24 |

As shown in Table 4, it is found that the charging roller 12*a* either passed or failed in the print test and the potentiometer test in the area B shown in FIG. 9. In the area B shown in FIG. 9, the maximum peak height Rp is larger than 10 μm and equal to or less than 12 μm, and the average profile length RSm is at least 40 μm and equal to or less than 250 μm, or the maximum peak height Rp is at least 2 μm and equal to or less than 12 μm and the average profile length RSm is larger than 200 μm and equal to or less than 240 μm.

Further, it is found that the charging roller 12*a* passed when the roughness parameter γ is equal to or smaller than 1.2 (γ≦1.2), and the charging roller 12*a* failed when the roughness parameter γ is greater than 1.2 (γ>1.2).

When the roughness parameter γ is greater than 1.2, the surface roughness is irregular. Accordingly, it is difficult to uniformly press the cleaning member 12*b* against the charging roller 12*a*, so that a film is formed on the surface of the charging roller 12*a*, thereby making it difficult to stably charge the photosensitive drum 11 with the charging roller 12*a* and deteriorating image quality.

On the other hand, when the roughness parameter γ is equal to or smaller than 1.2, the surface roughness is regular. Accordingly, it is possible to uniformly press the cleaning member 12*b* against the charging roller 12*a*, so that a film is not formed on the surface of the charging roller 12*a*, thereby making it easy to stably charge the photosensitive drum 11 with the charging roller 12*a* and improving image quality.

As described above, in the fourth embodiment, in the area B in the second embodiment, the charging roller 12*a* has the surface roughness controlled by the average profile length RSm, the maximum peak height Rp(a) measured under the conditions No. 1, and the roughness parameter γ. Accordingly, it is possible to securely prevent a film from forming on the surface of the charging roller 12*a*, thereby making it easy to stably charge the photosensitive drum 11 with the charging roller 12*a* and improving image quality. Further, it is possible to improve the durability of the charging roller 12*a*, the charging device 12, and the printer. Further, it is possible to reduce a noise due to friction between the cleaning member 12*b* and the charging roller 12*a*.

In the embodiments described above, the printer is explained as an example of an image forming apparatus, and the invention is not limited thereto. The invention can be applied to other image forming apparatus such as a copier, a fax machine, and a multifunction machine.

The disclosure of Japanese Patent Applications No. 2006-175588, filed on Jun. 26, 2006, and No. 2006-283734, filed on Oct. 18, 2006, are incorporated in the application by reference.

While the invention has been explained with reference to the specific embodiments of the invention, the explanation is illustrative and the invention is limited only by the appended claims.

What is claimed is:

1. A charging device for charging an image supporting member, comprising:

a charging roller for charging the image supporting member, said charging roller having a surface, said surface having one of first irregularity and second irregularity both oriented in a first direction, said first irregularity having a first maximum peak height Rp(a) measured under a first condition having a first standard length within the following range, 10 μm<Rp ≦12 μm, an average profile length RSm within the following range, 40 μm≦RSm≦250 μm, and a ratio of a second maximum peak height Rp(b) measured under a second condition having a second standard length larger than the first standard length to the first maximum peak height Rp(a) equal to or smaller than 1.2, said second irregularity having the first maximum peak height Rp(a) within the following range, 2 μm≦Rp≦12 μm, the average profile length RSm within the following range, 200 μm≦RSm≦250 μm, and the ratio equal to or smaller than 1.2; and a cleaning member adapted to slide against the charging roller in a second direction opposite to the first direction for cleaning the surface of the charging roller.

2. The charging device according to claim 1, wherein said cleaning member includes a sponge member.

3. The charging device according to claim 1, wherein said charging roller has the surface having the first irregularity and the second irregularity measured under the first condition having the first standard length of 0.8 mm and the second condition having the second standard length of 2.5 mm.

4. An image forming apparatus comprising the charging device according to claim 1; comprising the image Supporting member; an exposing device for exposing the image supporting member according to image data to form a latent image on the image supporting member; a developing device for supplying toner to the latent image to form a developer image on the image supporting member; a transfer device for transferring the developer image to a recording medium; and a fixing device for fixing the developer image to the recording medium.

* * * * *